US011932442B2

(12) United States Patent
Prieschl

(10) Patent No.: US 11,932,442 B2
(45) Date of Patent: Mar. 19, 2024

(54) STORAGE APPARATUS

(71) Applicant: Marco Prieschl, Randburg (ZA)

(72) Inventor: Marco Prieschl, Randburg (ZA)

( * ) Notice: Subject to any disclaimer, the term of this patent is extended or adjusted under 35 U.S.C. 154(b) by 116 days.

(21) Appl. No.: 17/048,873

(22) PCT Filed: Apr. 12, 2019

(86) PCT No.: PCT/ZA2019/050022
§ 371 (c)(1),
(2) Date: Oct. 19, 2020

(87) PCT Pub. No.: WO2019/204835
PCT Pub. Date: Oct. 24, 2019

(65) Prior Publication Data

US 2021/0237931 A1 Aug. 5, 2021

(30) Foreign Application Priority Data

Apr. 20, 2018 (ZA) ..... 2018/02629

(51) Int. Cl.
*B65D 6/24* (2006.01)
*B65D 19/18* (2006.01)
*B65D 21/02* (2006.01)
*B65D 77/06* (2006.01)

(52) U.S. Cl.
CPC ..... *B65D 11/1873* (2013.01); *B65D 19/18* (2013.01); *B65D 21/0201* (2013.01); *B65D 77/06* (2013.01); *B65D 2519/00273* (2013.01); *B65D 2519/00323* (2013.01); *B65D 2519/00333* (2013.01); *B65D 2519/00497* (2013.01); *B65D 2519/00572* (2013.01); *B65D 2519/00611* (2013.01)

(58) Field of Classification Search
CPC ..... B65D 11/1873; B65D 21/0201; B65D 43/165; B65D 11/18; B65D 11/1806; B65D 11/1846; B65D 11/186; B65D 11/1866; B65D 11/1893; B65D 21/083; B65D 21/08; B65D 21/086; B65D 81/361; B65D 88/005; B65D 90/023; B65D 15/24; B65D 88/522; B65D 88/52; B65D 9/14; B65D 7/28; B65D 7/26; B65D 7/24; A47B 47/0075
USPC ..... 220/4.34, 7, 4.33, 4.29, 23.4, 848, 844
See application file for complete search history.

(56) References Cited

U.S. PATENT DOCUMENTS 3,073,476 A * 1/1963 Heacock ..... B65D 7/24 220/639
3,250,421 A 5/1966 Braun
3,696,960 A * 10/1972 Smirle ..... B65D 25/02 220/DIG. 25

(Continued)

FOREIGN PATENT DOCUMENTS

CH 371389 A 8/1963

OTHER PUBLICATIONS

1 International Search Report from PCT/ZA2019/050022 dated Jul. 26, 2019, 2 pgs.

*Primary Examiner* — Robert Poon
(74) *Attorney, Agent, or Firm* — Tutunjian & Bitetto, P.C.

(57) ABSTRACT

A collapsible container which is made from at least five interconnected panels each of which is square with projections on each side which have passages through which hinge pins are passed to secure the panels together.

9 Claims, 8 Drawing Sheets

(56) References Cited

U.S. PATENT DOCUMENTS

| | | | | |
|---|---|---|---|---|
| 4,650,089 | A * | 3/1987 | Sanders | B65F 1/1646 220/908 |
| 4,765,480 | A * | 8/1988 | Malmanger | B65D 43/165 206/508 |
| 6,216,899 | B1 * | 4/2001 | Vicari | B65D 19/16 206/600 |
| 7,387,075 | B2 * | 6/2008 | Gaydos | B61D 17/16 105/281 |
| 2003/0141300 | A1 * | 7/2003 | French | B65D 21/0204 220/23.4 |
| 2013/0228583 | A1 * | 9/2013 | Mayer | B65D 81/3862 220/666 |
| 2015/0048082 | A1 | 2/2015 | Galal et al. | |
| 2018/0186511 | A1 * | 7/2018 | Sullivan | B65D 9/24 |

* cited by examiner

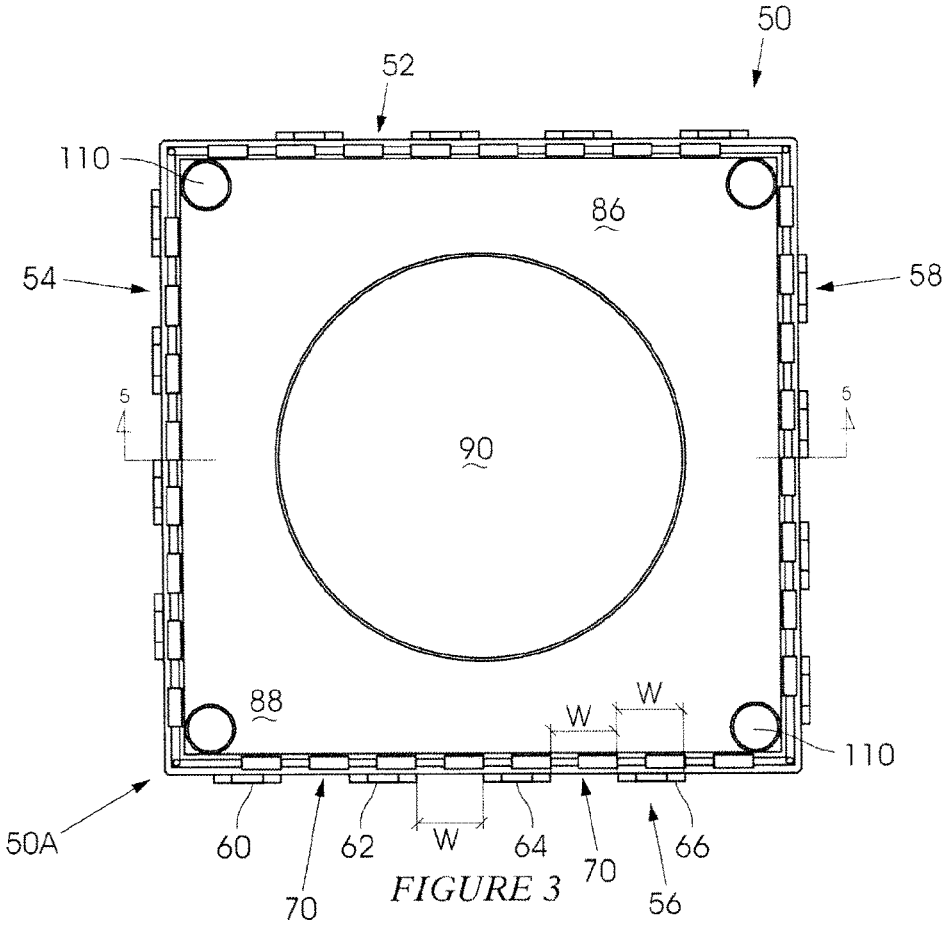
FIGURE 3
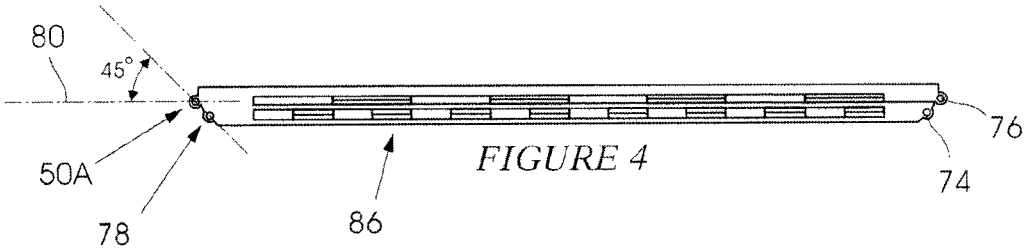
FIGURE 4
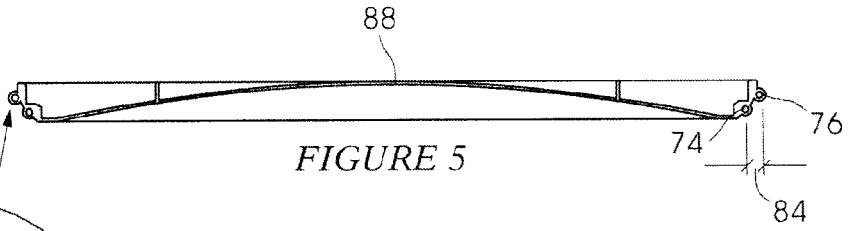
FIGURE 5
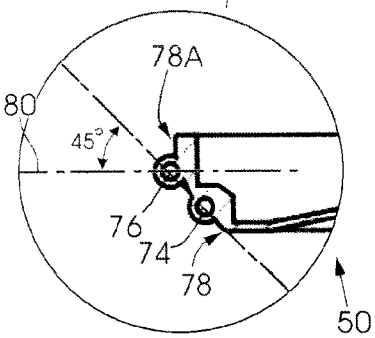

STORAGE APPARATUS

BACKGROUND OF THE INVENTION

This invention relates to storage apparatus in the form of a container. The invention is described hereinafter with reference to storage apparatus which can function as a liquid storage tank but it is to be understood that this is exemplary only and non-limiting.

A tank can be made in different ways. In one technique a tank is made from a plastics material by means of a rotomoulding process under factory conditions. The end product, although acceptable, does present certain logistical challenges in that the tank is bulky and this leads to storage and transport problems. To address this aspect it has been proposed to fabricate one or more components which can be assembled, normally by a user, when required. Examples of collapsible containers or tanks are described in U.S. Pat. Nos. 6,401,953, 9,555,921, 3,819,079, 5,938,059, 9,643,768, US2015/0175304, and US2015/0048082. A perceived drawback of the containers in these disclosures is that a number of different components are required in their fabrication. This adds to the cost of manufacture.

An object of the present invention is to provide a storage apparatus or container which has a reduced number of different parts, which can be provided in knock-down form and which can readily be assembled by a user when required.

SUMMARY OF INVENTION

The invention provides, in the first instance, a panel which includes a planar, polygonal frame with sides of equal length which encloses a space, a respective plurality of spaced apart projections on each side, each projection being formed with at least two passages which extend through the projection and which are parallel to the respective side, and a structure which is secured to the frame extending at least partly over the space.

The polygonal frame may have three, four or five sides. Other configurations are possible but less preferred.

The structure which extends over the space may be of any appropriate form, depending on the intended application of the panel. The structure may comprise a mesh material or have a slatted configuration. Preferably, the structure comprises sheet material which extends over the entire space.

Each passage may include a bore which is circumferentially enclosed. Alternatively a passage may comprise a channel, groove or the like and one or more parts of the channel, groove or the like may be circumferentially enclosed.

Each projection may include a third passage which is spaced from the at least two passages and which is parallel to the at least two passages.

The projections may be aligned with one another so that the passages in the respective projections are also aligned with one another.

The projections on each side may be arranged in a configuration which is identical to the configuration of the projections on any other side. This configuration may be such that the projections on one side of the panel can be interengaged with the projections on any side of an identical panel. When this is done the passages in the two sets of projections are brought into alignment with one another and form continuous pathways which may partly or totally circumferentially enclosed through the respective passages.

In one embodiment each projection has a width W and is spaced from an adjacent projection to form a gap between the adjacent projections which has a width W.

In one preferred embodiment, the panel has four sides, i.e. the frame is square, and the sheet material is continuous over the space.

Preferably the panel is notionally divisible into four identical sections by means of a first line which extends diagonally across the panel between first and second opposed corners, and a second line which extends diagonally across the panel between third and fourth opposed corners, of the panel.

The sheet material may be planar, or bowed, ribbed, or the like (in cross section) for rigidifying, strengthening or aesthetic purposes.

Each side of the panel may have a surface which is at an angle of 45° to a plane in which the frame lies.

The invention further extends to a collapsible storage apparatus which includes at least five of the square panels interconnected so that one panel forms a base and the remaining four panels form sides of the storage apparatus and extend upwardly from the base panel. The panels may be interconnected to one another using hinge pins which extend through the appropriate passages, in the projections, which are linearly aligned with one another.

A sixth panel may be used, coupled, for example in a hinged manner to an upper end of one of the side panels, to provide a lid for the storage apparatus.

A bladder which in use contains a liquid such as water may be positioned inside the storage apparatus.

The sheet material on each panel may be curved so that it extends outwardly from an interior of the storage apparatus—this feature takes into account the effects of pressure exerted by a liquid-filled bladder acting against an inner surface of the sheet material of a panel.

Each panel, at each of the four corner may include an opening through the sheet material, which opening can be closed, as required, through the use of a removable seal, or closure. A bladder inside the assembled storage apparatus may have an inlet spout engaged with an upper opening (in any vertical panel) and an outlet spout, preferably with a valve, at a lower opening—again on a vertical panel. This arrangement is particularly suitable for an application in which the bladder is to be filled with a liquid e.g. rainwater.

BRIEF DESCRIPTION OF THE DRAWINGS

The invention is further described by way of examples with reference to the accompanying drawings in which:

FIG. 3 is a plan view of a panel according to another form of the invention;

FIG. 4 is a side view of the panel shown in FIG. 3;

FIG. 5 is a view in cross section taken on a line 5-5 of the panel shown in FIG. 3;

DESCRIPTION OF PREFERRED EMBODIMENTS

Figure 1:
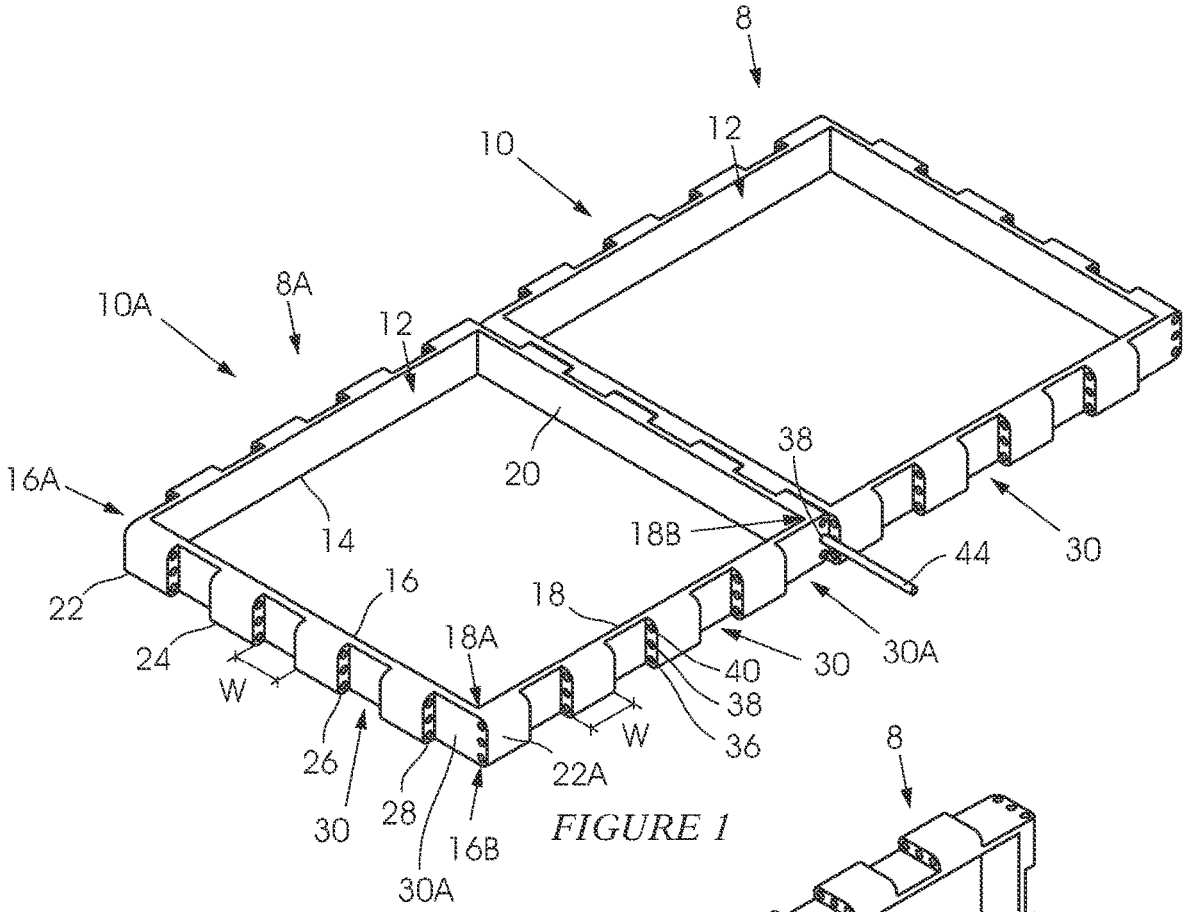
FIG. 1 illustrates in perspective two panels according to one form of the invention.

FIG. 1 of the accompanying drawings illustrates two identical panels 8 and 8A which respectively include polygonal planar frames 10 and 10A.

The frame 10 has a moulded plastics body 12 with four sides 14, 16, 18 and 20 respectively which are of equal length. The body 12 is formed in an injection moulding process. The sides are identically configured. Thus the construction of only one side is described.

The side 16 has four projections 22 to 28 which extend laterally from the side. Adjacent projections are spaced apart to form a gap 30, which has a width W, between adjacent projections.

The configurations of the projections on each side are identical. Thus referring, for example, to the side 16 the projection 22 is at an end 16A while a space 30A equivalent to a gap 30 is at an opposing end 16B. The end 16B is adjacent an end 18A of the side 18 and a projection 22A is at this end. At an opposing end 18B of the side 18 there is another space 30A which is equivalent to the gap 30. Thus, in effect, the alternating sequence of projections and gaps continues uninterrupted around the periphery of the frame.

Each projection is formed with three passages 36, 38 and 40 which are spaced apart from one another and which are parallel to the respective side. The passages on each side are aligned i.e. they are in register with one another. Each passage comprises a circular bore which is enclosed in a circumferential sense on all sides.

In FIG. 1 the two frames 10 and 10A are arranged side-by-side in the same plane. The projections and the gaps 30 on abutting sides of the frames interlock with each other. In so doing the passages 36 to 40 on one set of projections are brought into alignment with corresponding passages 36 to 40 on an adjacent set of projections. The aligned passages 36 to 40 form three continuous pathways which extend through the abutting projections from the side 18 to the side 14.

An elongate hinge pin is used to connect adjacent panels 8 and 8A to one another. This can be done in one of two ways. In FIG. 1 the elongate hinge pin 44 is passed through the centrally positioned aligned passages 38. Due to the closely abutting surfaces of the interlocking projections and gaps 30 the hinge pin 44, in the FIG. 1 configuration, fixes the panels 8 and 8A together in a manner which does not permit any meaningful degree of pivotal movement of one panel relative to the other.

Figure 2:
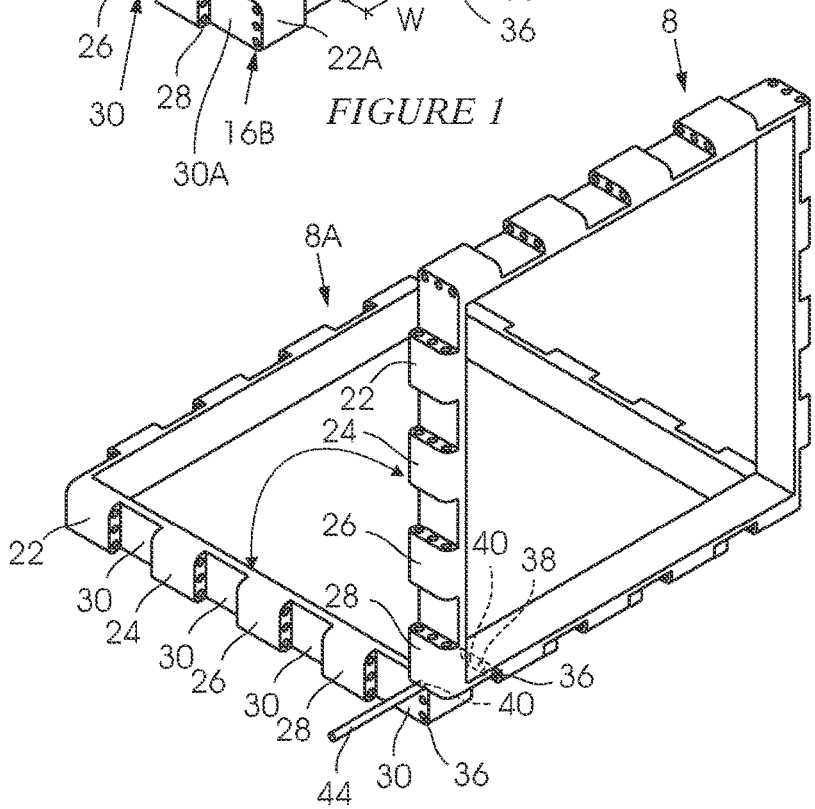
FIG. 2 shows the panels of FIG. 1 interconnected and extending at an angle of 90° to each other.

FIG. 2 shows an arrangement in which the hinge pin 44 is passed through the aligned passages 40 in the projections. The positioning of the passages 40 is such that the panel 8A can be pivoted through 90° from a planar arrangement of the kind shown in FIG. 1 relative to the panel 8.

If the hinge pin 44 were to be passed though the aligned passages 36 it would be possible to pivot the panel 8A through an angle of 90° relative to the panel 8, but in an opposing direction to that shown in FIG. 2.

FIG. 3 is a plan view of a panel 50 which is based on the concept described in connection with FIGS. 1 and 2. The panel 50 has a planar polygonal frame 50A with four sides 52, 54, 56 and 58 respectively which are of equal length. Each side carries a plurality of projections 60 to 66 respectively and adjacent projections are spaced apart from one another to form respective intervening gaps 70 with each gap having a width W which is the same as the width W of each projection.

FIG. 4 is a side view of the panel 50 shown in FIG. 3 while FIG. 5 shows the panel in cross section taken on a line 5-5 in FIG. 3.

In this instance, each projection 60 to 66 is formed with two passages 74 and 76 respectively which extend through the projection (60 to 66) and which are parallel to the corresponding side (52 to 58). An outer surface 78 of each side 52 to 58 is chamfered at an angle of 45° relative to a plane 80 in which the frame 50A lies. Thus, see FIGS. 4 and 5, the passages 74 are displaced "inwardly" relatively to the passages 76, by a distance 84.

The insert drawing to FIG. 5 shows, on a slightly enlarged scale, the chamfered outer edge 78 of a side of the panel. Centre lines of the passages 74, 76 lie on a line which is coincident with the outer edge surface. Also, on what in use is an outer side of the panel 50, the chamfer is discontinued and the outer edge 78 has a section 78A adjacent the outer passage 76 which is more or less at a right angle to the plane 80. These geometrical aspects are important for, as is apparent from the following description, the 45° chamfer allows abutting edges 78 of adjacent panels 50 to nest closely with one another and the offset edge surface 78A, which is at a right angle to the plane 80, allows one panel to be pivoted relative to another panel to which it is connected.

The frame 50A bounds a space 86. This space is covered by structure 88 which comprises a curved pressure membrane in the form of sheet material, of a suitable shape and dimensions, which is integrally formed with the frame 50A in an injection moulding process. A central portion 90 of the membrane has a domed shape for rigidifying/strengthening purposes.

Figure 6:
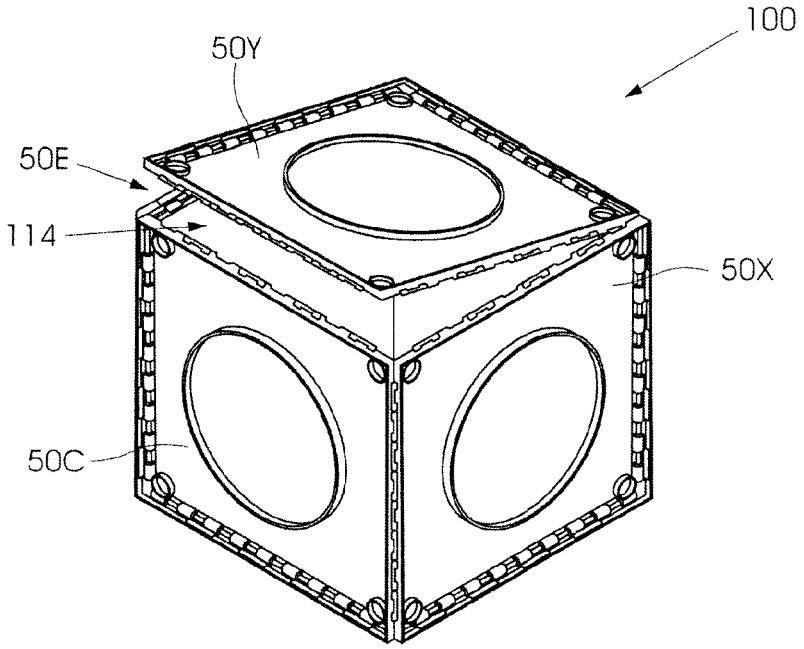
FIG. 6 illustrates, in perspective, a storage apparatus or container assembled from six panels each of the kind shown in FIG. 3.
Figure 7:
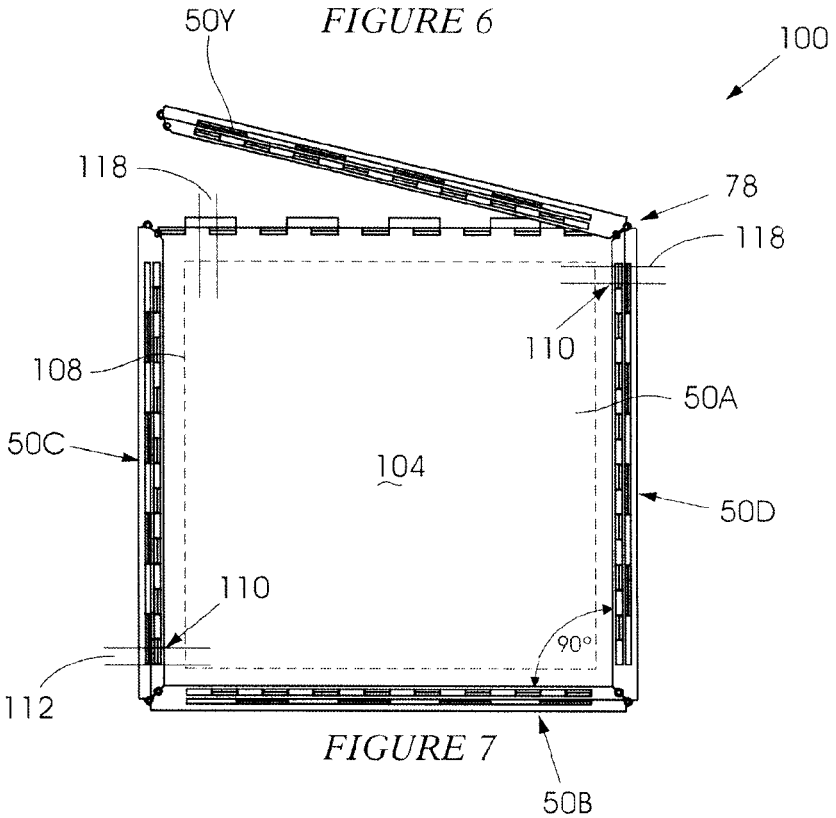
FIG. 7 is a side view of the container shown in FIG. 6 but with one side panel removed.

FIG. 6 is a view in perspective of a storage apparatus 100 which is made from six identical panels each of the kind 50 shown in FIGS. 3 to 5. FIG. 7 shows the storage apparatus 100 from one side with a panel which is marked 50X in FIG. 6 removed. A panel marked 50B forms a base for the apparatus. Sides of the apparatus 100 are constituted by four of the panels 50C, 50D, 50E and 50X which are respectively fixed to the base panel 50B in the manner shown in FIG. 2. As the edges 78 are chamfered, as has been described in connection with FIGS. 4 and 5, the passages 74 in the projections 60 to 66 are only aligned with one another when adjacent panels are interlocked and subtend an angle of 90° between them. A hinge pin 44, not shown in FIG. 6 nor in FIG. 7, is pushed through the aligned passages 74 to secure the panels together. As a result of the chamfered edges 78 the strength of the resulting structure is enhanced. The base panel 50B is fixed to each of the four side panels 50X, 50C, 50D and 50E. Each side panel, apart from being fixed to the base panel 50B, is fixed at its opposed vertical edges to adjacent side panels. A cubic structure results.

The configuration is such that the curved pressure membrane on each panel extends outwardly i.e. away from an interior 104 of the cubic structure.

The "outer" passages 76, in abutting edges of adjacent panels at the base and on the sides, although aligned with one another, are not normally interconnected by means of pins.

A sixth panel marked 50Y is attached to an upper edge of one of the side panels, using a hinge pin 44. This pin is passed through the aligned "outer" passages 76—this allows the panel 50Y to form a lid which is movable with a hinge action upwardly or downwardly. When the panel 50Y is fully lowered, it can be attached to upper edges of the remaining three side panels using one or more pins, in the manner described, to form a secure cubic structure which can be used for diverse purposes.

FIG. 7 illustrates in dotted outline a flexible water bladder 108 which is positioned inside the volume 104 after the side panels 50C, 50D, 50E and 50X have been fixed to the base panel 50B. Each panel 50, see FIG. 3, is formed with four holes or openings 110 in the sheet material structure 88 near each corner of the panel. An outlet valve 112, from the bladder 108, is passed through a selected hole 110 in one of the side panels and is fixed in position. An inlet valve 118 at an upper end of the bladder 108 is passed through a selected hole 110, in a side panel, and is fixed in position. In this configuration the storage container can be used as a tank for storage of a liquid.

A significant benefit of the invention lies in the fact that a storage container or tank can be constructed from a number of components which are identical in shape and size. As each panel 50 is injection-moulded this means that the tooling for a single panel suffices for the manufacture of all of the panels. The panels are made available to a user, or are provided for storage and transport purposes, in a knock-down form. Only six panels and a bladder are required to make a tank. For example, six panels and a bladder which can accommodate approximately 900 litres collectively weigh about 24 kilograms. A mass of this size is readily handled. Also the dimensions of the components in knock-down form are such that they can easily be transported in an appropriate vehicle.

Figure 8:
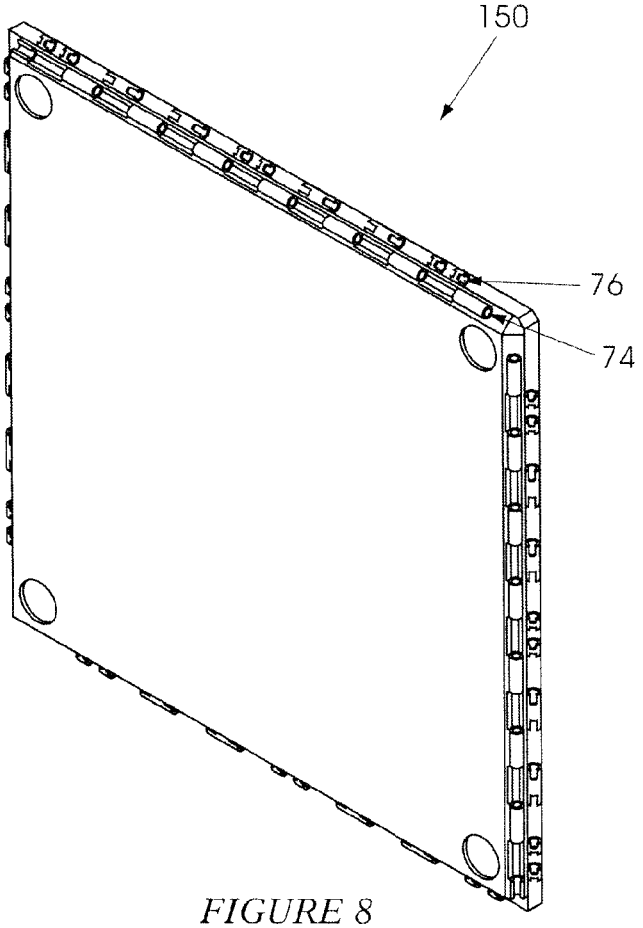
FIG. 8 is a perspective view of a panel which is a modified form of the panel shown in FIG. 3.

FIG. 8 illustrates, in perspective, a panel 150 which is substantially the same as the panel 50 described hereinbefore. Where applicable like reference numerals are used to designate like components. It is to be noted though that the "inner" passages 74 comprise bores which are circumferentially totally enclosed while the "outer" passages 76 are in the form of channels or grooves and are not completely enclosed in a circumferential sense. Generally speaking the "inner" passages 74 are used for permanent, strong connections which are made through the use of the hinge pins 44 while the outer passages allow for hinged connections of adjacent panels to be made easily.

Figure 9:
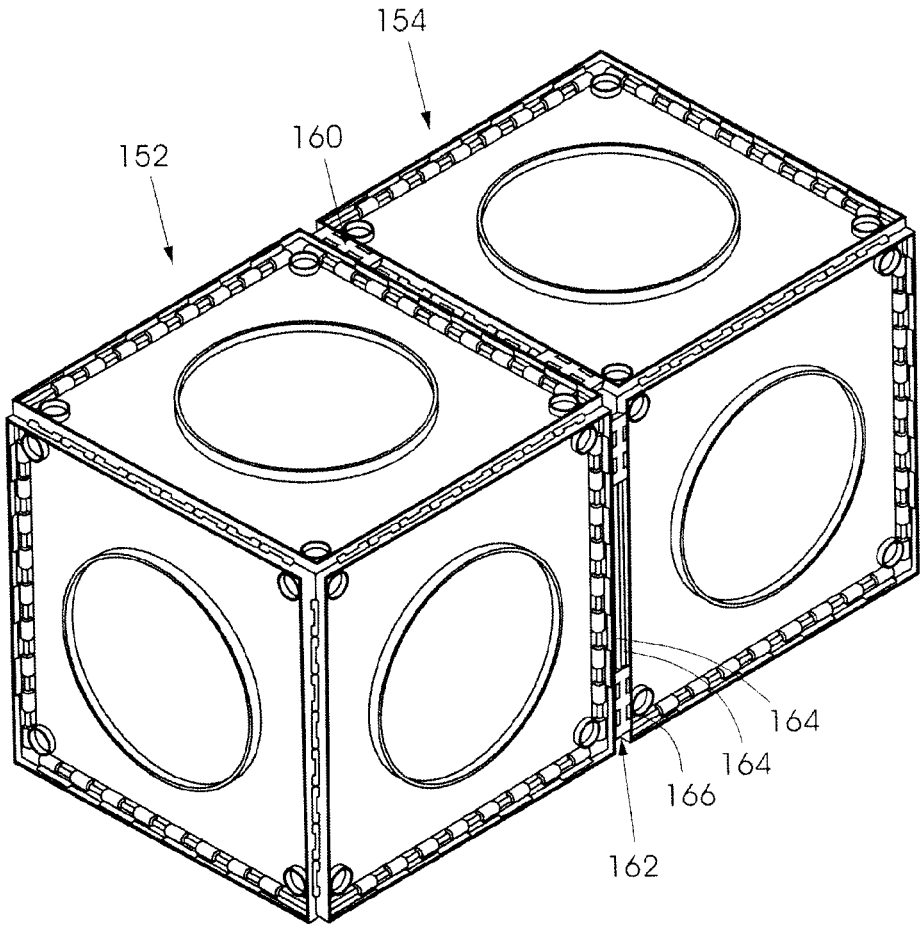
FIG. 9 shows two interconnected storage containers, each similar to what is shown in FIG. 6, positioned side by side.

FIG. 9 shows two containers 152 and 154 respectively, each of which is made in the manner which has been described. The containers 152 and 154 are positioned side-by-side adjacent each other and are coupled together using connectors or brackets 160 which form bridging pieces between the adjacent containers. Each bracket 160 comprises a body 162 with spaced apart projections 164 on each of its opposing longitudinal sides. Each projection 164 is formed with a passage 166 which is similar to the passage 76. The body 162 can then be positioned adjacent and between respective edges of the adjacent containers 152, 154 and short pins, not shown, are passed through the passages 166 which are aligned with the passages 76 in the respective containers.

In FIG. 9 two brackets 160 are used on each of two adjacent vertical sides, and on the adjacent upper sides of the containers.

Figure 10:
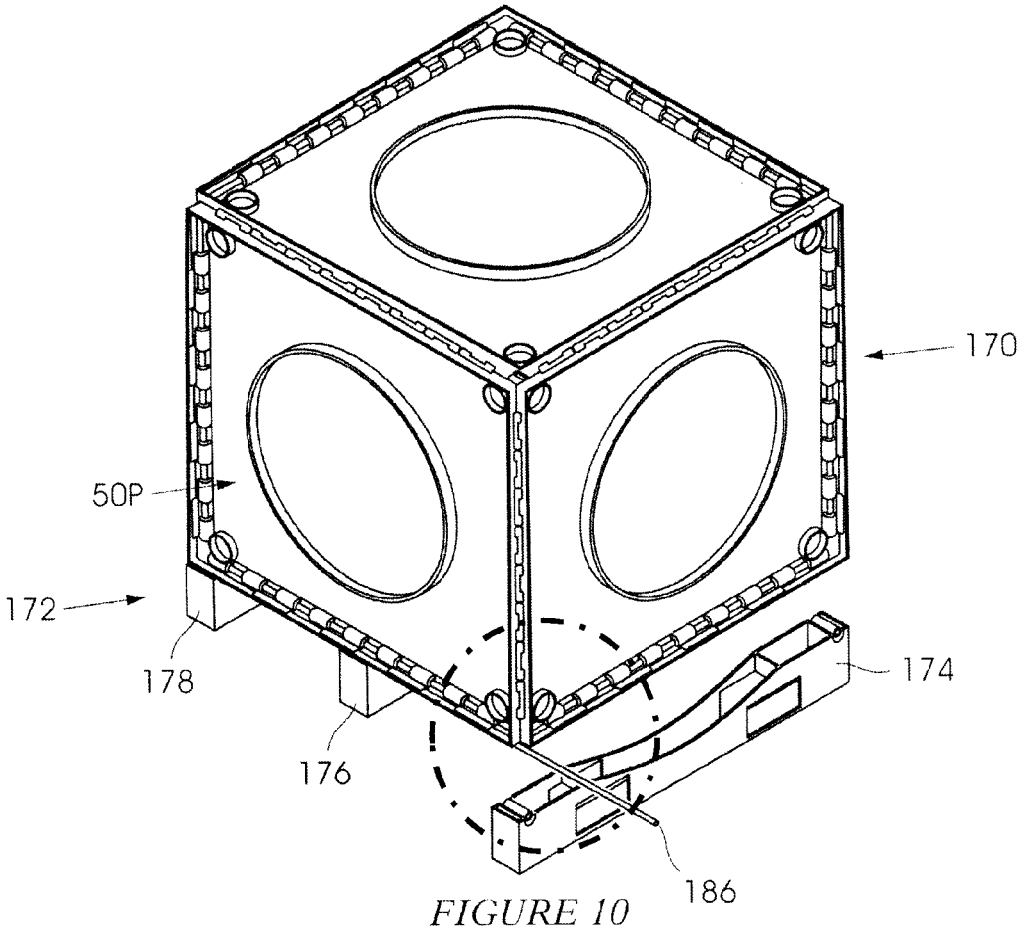
FIG. 10 shows a storage container according to the invention with a pallet conversion.
Figure 10A:
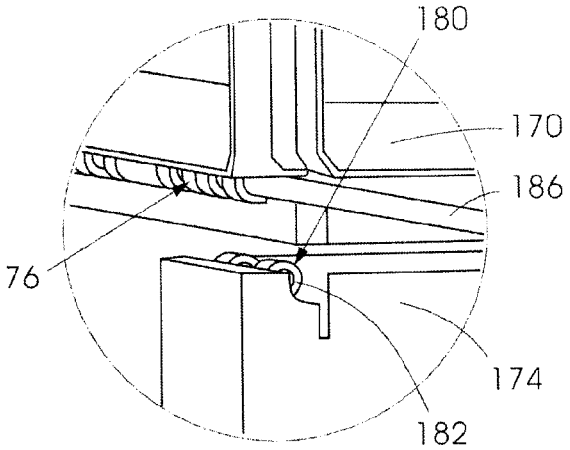
FIG. 10A shows, on an enlarged scale, a part of the container in FIG. 10, which is enclosed in a circle marked "A"

FIG. 10 illustrates how a container 170 is adapted to be used with a pallet structure 172 which includes three pallet beams 174, 176 and 178 respectively. FIG. 10A illustrates on an enlarged scale a part of the pallet beam 174 and an underside of the container 170. The pallet beam 174, at each of its opposed upper corners has projections 180 through which are formed passages 182. These passages are brought into alignment with the corresponding passages 76 on an under-side of a vertical panel 50P. A pin 186 is then passed through the aligned passages 182 and 76. A similar arrangement is adopted at an opposing end of the pallet beam 174.

Figure 11:
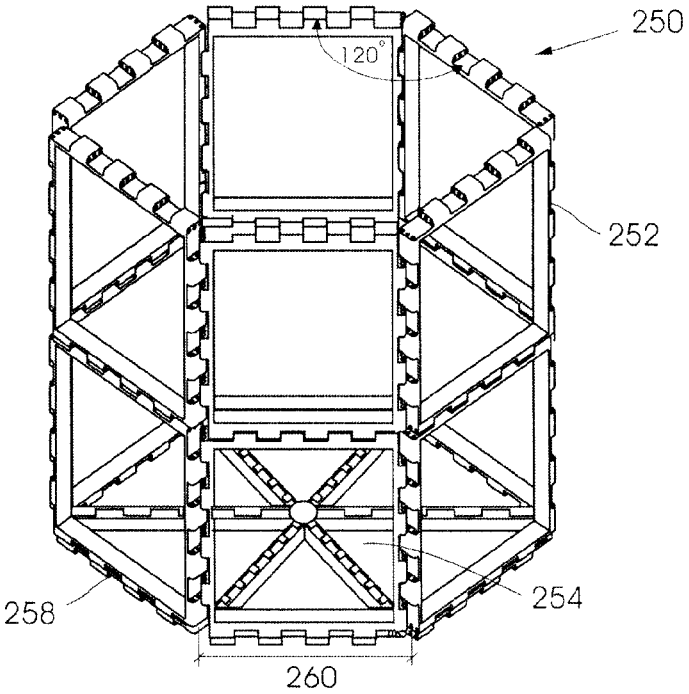
FIG. 11 illustrates how a hexagonal container can be constructed from square panels and triangular panels.
Figure 12:
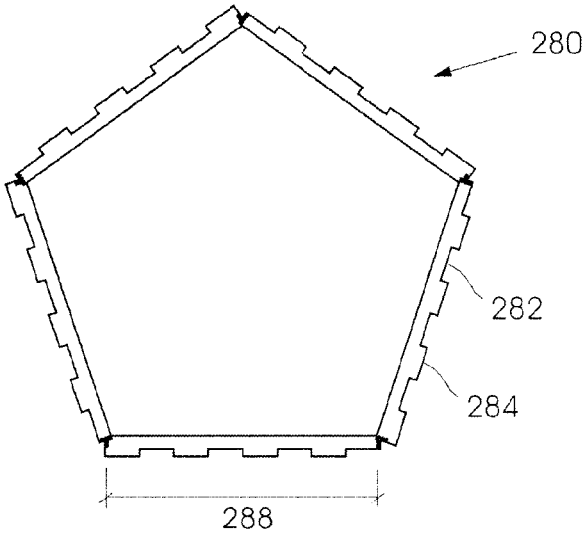
FIG. 12 illustrates a panel according to the invention which has five sides.

The invention has been described particularly with reference to a panel which has four sides. This configuration is non-limiting. For example, FIG. 11 shows a hexagonal structure 250, typically a tank, which is made from twelve square panels 252 and six triangular panels 254. The triangular panels 254 are identical to one another and are made in a similar manner to what has been described in connection with the square panels 50. The triangular panels 254 are interconnected using hinge pins (not shown) in a manner similar to that shown in FIG. 1. The triangular panels 254 have sides 258 of equal length. Each side 258 matches a length 260 of a square panel 252 and can be interlockably engaged with that side in a manner similar to that shown in FIG. 2. Adjacent side panels 252 are displaced by an angle of 120° from one another FIG. 12 illustrates merely by way of example a panel 280 which is of pentagonal form. The panel 280 has a planar five-sided form with sides 282 of equal length. Each side 282 carries projections 284 of the kind which have been described hereinbefore. The pentagonal panel 280 can be used in different ways but typically square panels (not shown) would be used with the five sided panel 280. Each square panel would have a side with a length equal to a length 288 of a side of the five-sided panel and it is then possible to connect the square panels to form walls of a tank in which the five-sided panel forms a base in a similar manner to that illustrated in FIG. 11.

Figure 13:
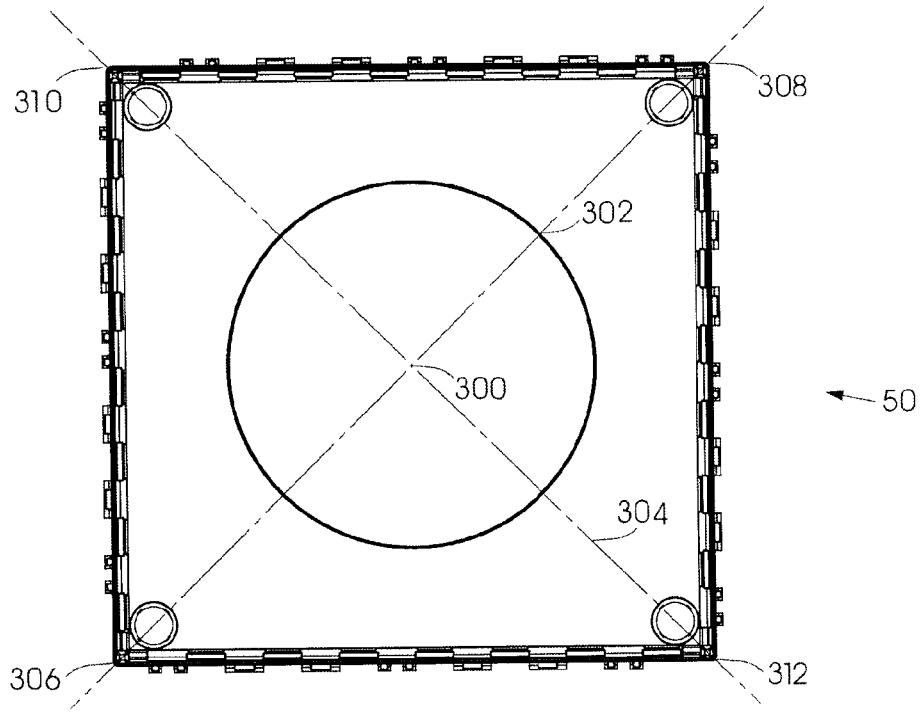
FIGS. 13 and 14 illustrate that the panel of the invention has a symmetrical construction.
Figure 14:
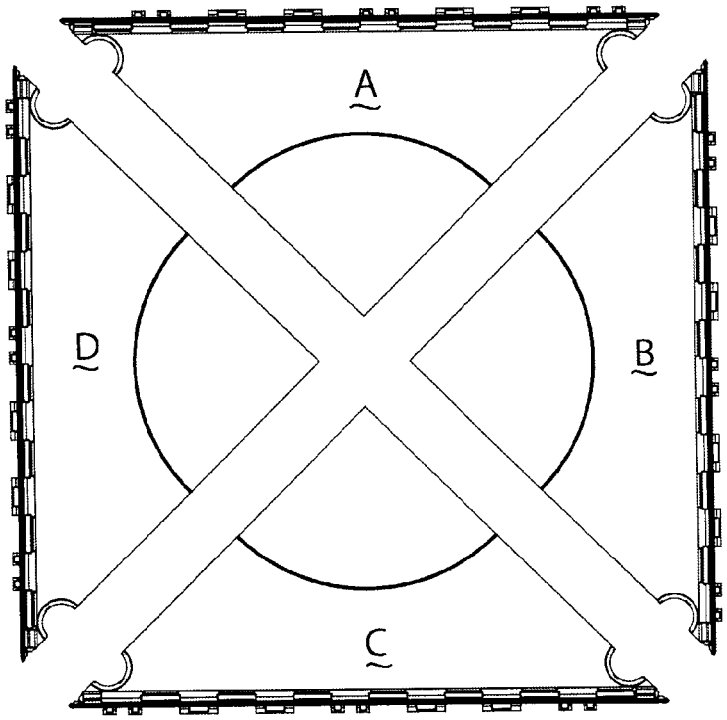

An aspect of the invention which is particularly important to the preferred embodiment in which a panel 50 which is square in outline (see FIG. 3) is that the panel includes four substantially identical sections. This feature is evident from a comparison of FIGS. 13 and 14. The former Figure shows a panel 50 with a geometrical centre 300. The panel can be notionally divided into four quarters, A, B, C and D (see FIG. 14), by two transverse lines 302 and 304 which extend diagonally across the panel between opposed corners 306 and 308, and 310 and 312, respectively. The quarters or segments of the panel, notionally divided in the aforementioned manner, are shown separated from one another in FIG. 14. It can be seen that these segments are identical to one another. This aspect is important for it allows for the storage apparatus of the invention to be assembled from identical panels and there is no need to distinguish one panel from another nor is it necessary to comply with any particular orientation of a panel in order to assemble the storage apparatus.

The invention claimed is:

1. A panel arrangement, comprising:

a first panel and a second panel each panel comprising a planar, polygonal frame having sides of equal length which encloses a space, a respective plurality of spaced apart elongate projections on each side, a respective gap between each adjacent pair of projections on each side, each projection being formed with at least two passages which extend through the projection and which are parallel to the respective side, wherein the at least two passages in the respective projections are linearly aligned with one another thereby to form at least two continuous pathways which extend though the projections, wherein said projections and gaps on a first side of the first panel are positioned to interlock with said gaps and projections on a first side of the second panel such that the passages in the projections on the first side of the first panel are linearly aligned with the passages on the first side of the second panel and the aligned passages form continuous pathways through the projections, wherein a hinge pin, passed through one of said pathways of aligned passages, of the first and second panels connects the first panel to the second panel, wherein the first panel is pivotally moveable about the hinge pin relative to the second panel in a first direction, and wherein when the hinge pin is passed through another of said continuous pathways of aligned passages, it connects the first panel to the second panel and limits the pivotal movement of the first panel relative to the second panel in the first direction.

2. The panel arrangement of claim 1, wherein each panel respectively includes a structure secured to the frame extending at least partly over the space.

3. The panel arrangement of claim 2, wherein the structure comprises sheet material extending over the space.

4. The panel arrangement of clause 3, wherein the sheet material comprises a curved pressure membrane.

5. The panel arrangement of claim 2, wherein, in respect of each panel, each side of the panel has a surface which is at an angle of 45° to a plane in which the frame lies.

6. The panel arrangement of claim 5, wherein, in respect of each panel, each side has a surface section which is at a right angle to the plane.

7. The panel arrangement of claim 5, wherein, in respect of each panel, each side has a surface rotation which is at a right angle to the plane.

8. The panel arrangement of claim 1, wherein each passage comprises a circular bore.

9. The panel arrangement of claim 1, comprising a third panel which comprises a planar, polygonal frame having sides of equal length which encloses a space, a respective plurality of spaced apart elongate projections on each side, a respective gap between each adjacent pair of projections on each side, each projection being formed with at least two passages which extend through the projection and which are parallel to the respective side, wherein the at least two passages in the respective projections are linearly aligned with one another thereby to form at least two continuous pathways which extend though the projections, wherein said projections and gaps on a first side of the third panel are positioned to interlock with said gaps and projections on a second side of the first panel such that the passages in the projections on the first side of the third panel are linearly aligned with the passages on the second side of the first panel and the aligned passages form continuous pathways through the projections, wherein a hinge pin, passed through one of said pathways of aligned passages of the first and third panels connects the third panel to the first panel such that the third panel is pivotally moveable about the hinge pin relative to the first panel in a second direction and wherein when the hinge pin is passed through another of said at least two continuous pathway of aligned passages, it connects the third panel to the first panel and limits the pivotal movement of the third panel relative to the first panel in the third direction, wherein said projections and gaps on a second side of the third panel are positioned to interlock with said gaps and projections on a third side of the second panel such that the passages in the projections on the second side of the third panel are linearly aligned with the passages on the third side of the second panel and the aligned passages from continuous pathways through the projections, wherein a hinge pin, passed through one of said pathways of aligned passages of the second and third panels connects the third panel to the second panel such that the third panel is pivotally moveable about the hinge pin relative to the second panel, in a third direction and wherein when the hinge pin is passed through another of the said at least two continuous pathways of aligned passages, it connects the third panel to the second panel and limits the pivotal movement of the third panel relative to the second panel in the third direction.

* * * * *